US008683764B2

(12) United States Patent
Smith et al.

(10) Patent No.: US 8,683,764 B2
(45) Date of Patent: Apr. 1, 2014

(54) SNAP-IN GLASS BLOCK SYSTEM

(71) Applicant: Extech/Exterior Technologies, Inc., Pittsburgh, PA (US)

(72) Inventors: Kevin P. Smith, Glenshaw, PA (US); William P. Voegele, Jr., Pittsburgh, PA (US)

(73) Assignee: Extech/Exterior Technologies, Inc., Pittsburgh, PA (US)

( * ) Notice: Subject to any disclaimer, the term of this patent is extended or adjusted under 35 U.S.C. 154(b) by 0 days.

(21) Appl. No.: 13/771,173

(22) Filed: Feb. 20, 2013

(65) Prior Publication Data

US 2013/0239501 A1 Sep. 19, 2013

Related U.S. Application Data

(60) Provisional application No. 61/602,643, filed on Feb. 24, 2012, provisional application No. 61/664,197, filed on Jun. 26, 2012.

(51) Int. Cl.
*E04B 5/46* (2006.01)

(52) U.S. Cl.
USPC ..... 52/308; 52/306; 52/580; 52/590.2; 52/235

(58) Field of Classification Search
USPC ..... 52/306, 307, 308, 580, 591.1, 592.2, 52/204.7, 428, 565, 586.2, 590.2, 591.5, 52/592.1, 592.3, 592.6, 605, 775, 204.62, 52/204.64, 204.69, 656.5, 656.6, 214, 204, 52/599, 384, 392, 235
See application file for complete search history.

(56) References Cited

U.S. PATENT DOCUMENTS

| | | | | | |
|---|---|---|---|---|---|
| 4,724,637 | A * | 2/1988 | Evans | 52/209 |
| 4,965,975 | A * | 10/1990 | Schwarz | 52/308 |
| 4,999,964 | A * | 3/1991 | Taylor | 52/477 |
| 5,003,744 | A * | 4/1991 | Taylor | 52/308 |
| 5,033,245 | A | 7/1991 | Kline | |
| 5,367,846 | A | 11/1994 | von Roenn, Jr. | |
| 5,588,271 | A | 12/1996 | Pitchford | |
| 5,836,125 | A | 11/1998 | Regina | |
| 6,026,621 | A * | 2/2000 | Fisher | 52/308 |
| 6,301,843 | B1 * | 10/2001 | Silverman | 52/204.5 |
| 6,701,686 | B1 * | 3/2004 | Platt | 52/506.07 |
| 6,922,961 | B2 * | 8/2005 | Wright | 52/308 |
| 6,988,341 | B2 | 1/2006 | Regina | |
| 7,007,436 | B1 | 3/2006 | Kelley | |
| 7,043,885 | B2 * | 5/2006 | LeMert | 52/308 |
| 7,114,299 | B2 * | 10/2006 | Ringness | 52/204.1 |
| 2004/0040249 | A1 * | 3/2004 | Herbison | 52/677 |
| 2004/0088935 | A1 * | 5/2004 | Wright | 52/306 |
| 2004/0088936 | A1 * | 5/2004 | Wright | 52/307 |

* cited by examiner

*Primary Examiner* — Robert Canfield
*Assistant Examiner* — Matthew Gitlin
(74) *Attorney, Agent, or Firm* — McKay & Associates, P.C

(57) ABSTRACT

A block wall system comprising a framework having a perimeter, an intermediate vertical mullion, and an intermediate horizontal mullion with the blocks retained therein using flexible flanges. The intermediate vertical mullion and the intermediate horizontal mullion define one or more cavities within the framework. A block has a top, a bottom, a front face, a back face, and a pair of narrow faces. One or more detents are defined within each narrow face. Next, a flange is anchored within the intermediate vertical mullion, wherein the flange flexes and thereafter retracts to embed itself into the detent of the block when the block is inserted into the cavity such that the block is retained within the framework, thereby eliminating the need to use a fastener directly into or against the block to secure the block within the framework.

17 Claims, 9 Drawing Sheets

SNAP-IN GLASS BLOCK SYSTEM

CROSS-REFERENCE TO RELATED APPLICATIONS

The instant application claims benefit established by U.S. Provisional Application Ser. Nos. 61/602,643 filed Feb. 24, 2012 and 61/664,197 filed Jun. 26, 2012, the contents of both of which are incorporated herein by reference.

BACKGROUND

1. Field of the Invention

The present invention relates to wall systems. In particular, the instant system includes wall components which allow blocks such as glass block to be inserted into a final position and secured without the need for specialized tools or expertise.

2. Description of the Related Art

For many years, glass blocks have been used as building materials for walls, skylights, and floors. There have been problems with existing systems for glass block however. For one, the glass blocks are typically set in rigid or semi-rigid mortar which tends to crack and leak with age. Proper mixing of mortar requires the expertise of a trained mason. When mortar is mixed at the job site, there is little control over the amount of water added and, therefore, the strength and weather-ability of the mortar is impacted. Mortared block walls, even when reinforced, have limited structural strength. Alignment of block laid at the job site is also often inconsistent and requires a work space large enough to accommodate bags of mortar, water and mixing equipment. Also, field weather conditions are often unpredictable, affecting the quality of mortared glass block walls built on site. Because mortar takes time to properly cure (harden), the installer must remobilize to the site to remove remaining mortar residue after it has been allowed to cure. Uncured glass block walls cannot be exposed to excessive wind loads and must be barricaded to prevent impact loads, often difficult in occupied spaces. Finally, replacement of damaged glass block units in a mortared system is difficult and time consuming because of the need for special tools, materials and expertise. Repairs are often visually objectionable because the fresh mortar does not match that of weathered mortar.

Mortarless wall systems, particularly those comprising blocks, are known in the art. The blocks are traditionally held in forms or frames and secured thereto using brackets, flanges, or by bonding. For example, U.S. Pat. No. 7,114,299 to Ringness shows a glass block frame for forming a window or wall, which has at least one removable perimeter retainer member releasably connected to a respective perimeter member and including a flange for retaining the glass block. U.S. Pat. No. 7,007,436 to Kelley teaches a snap-in-place building block for a constructing wall, which has a male interlocking device positioned below a frame flange of an internal support bracket, in alignment with female interlocking devices positioned on either side of a rebar clip.

As it relates particularly to glass blocks, there are only so many locations along the block that can be used as a fastening point to a structural frame because it is essential that the aesthetics of the glass wall be maintained. Therefore, wall systems have been developed which allow glass blocks to be assembled to form a wall system without an undue number of screws, fasteners and required tools, thereby easing the assembly. For instance, U.S. Pat. No. 7,373,763 to Voegele, Jr. et al. describes a glass block assembly for use as building material in a wall, which has structural rods extending entirely across the structural perimeter frame so that primary and secondary muntins form a matrix within the perimeter frame to receive glass blocks. In this manner integral blocks can be dropped into the frame or muntin matrix and secured using fasteners driven through the perimeter of the frame only.

In the field of construction, particularly the building of walls and screen walls, it is often desirable to have a system wherein individual wall components can be inserted into their final positions in a manner where spring-loaded elements will snap into detents and thus secure the units in place without the need for specialized tools or expertise. The ability to insert units in this way is especially convenient in cases where existing units may be damaged and replacement units are to be installed, ideally, very quickly and without special tools or expertise. This is especially desirable when centrally-located blocks may be damaged, which traditionally would require the removal of other blocks or components of the wall in a sequential fashion. The present invention satisfies all of these needs and others, as follows.

SUMMARY

It is the objective of the instant invention to provide a block wall system wherein the blocks are inserted into the framework and fixed therein without the need for tools, additional fasteners or special expertise.

It is further the objective to provide a block wall system wherein the glass blocks can easily be replaced.

It is further the objective to provide a block wall system wherein the assembly process can be performed very quickly.

It is further the objective to provide a block wall system that is ready for use immediately following installation.

It is further the objective of the instant invention to maintain the aesthetics of glass wall systems by reducing the amount of fasteners required for assembly.

Accordingly, the instant invention comprehends a block wall system, comprising a framework having a perimeter, an intermediate vertical mullion, and an intermediate horizontal mullion. The intermediate vertical mullion and the intermediate horizontal mullion define one or more cavities within the framework. A block has a top, a bottom, a front face, a back face, and a pair of narrow faces. One or more detents are defined within each narrow face. Next, a flange is anchored within the intermediate vertical mullion, wherein the flange flexes and thereafter retracts to embed itself into the detent of the block when the block is inserted into the cavity such that the block is retained within the framework, thereby eliminating the need to use a fastener directly into or against the block to secure the block within the framework.

In one embodiment the block is a glass block and the detent of the glass block is a triangular aperture. The flange therefore is a strip having a free end distal to the intermediate vertical mullion and a fixed end anchored within the intermediate mullion or perimeter such that the flange can flex upon a compression force being applied to the free end and retract into the triangular aperture of the glass block upon relaxation, thereby snapping the block into place after the glass block is pushed forward into the cavity.

In a further embodiment the detent of the glass block is a rectangular slot, and the intermediate vertical mullion has two end portions and includes a medial portion and a pair of narrow portions on opposing sides of the medial portion terminating at the end portions. Each narrow portion is defined by a cut-out down into the medial portion angling towards the end portions. In this manner the flange is an S-shaped clip having a perpendicular end adapted to flex down into the cut-out and for engaging the rectangular slot upon retraction, and a bent end anchored within an intermediate slot defined within the medial portion acting as a fulcrum for the perpendicular end such that when the block is pushed forward into the cavity the perpendicular end, upon snapping into the rectangular slot, locks the glass block into place.

DETAILED DESCRIPTION OF THE PREFERRED EMBODIMENT

The invention will now be described in detail in relation to a preferred embodiment and implementation thereof which is exemplary in nature and descriptively specific as disclosed. As is customary, it will be understood that no limitation of the scope of the invention is thereby intended. The invention encompasses such alterations and further modifications in the illustrated assembly, and such further applications of the principles of the invention illustrated herein, as would normally occur to persons skilled in the art to which the invention relates. This detailed description of this invention is not meant to limit the invention, but is meant to provide a detailed disclosure of the best mode of practicing the invention.

In the present invention, a block or block-like unit, such as a glass block or masonry block or a metal-clad block element, is inserted into a cavity in a framework (typically made of metal such as aluminum) which defines a wall or screen. In so doing, it is desirable to be able to fix that element into the cavity quickly and securely and without special tools. The wall or screen, also termed herein "system" may comprise one or more blocks, mullions, and other components depending on its size and other installation requirements. Therefore, "a" or "an" as used in the claims means one or more.

In the present invention, the framework that forms the cavity includes flanges along at least two sides of the cavity. These flexible flanges are positioned such that, when the block is forced forward into the cavity, the flex action of the flanges allows them to be pushed aside, only to flex back and engage detent in the blocks whenever they have been pushed farther into their final resting places.

Figure 1:
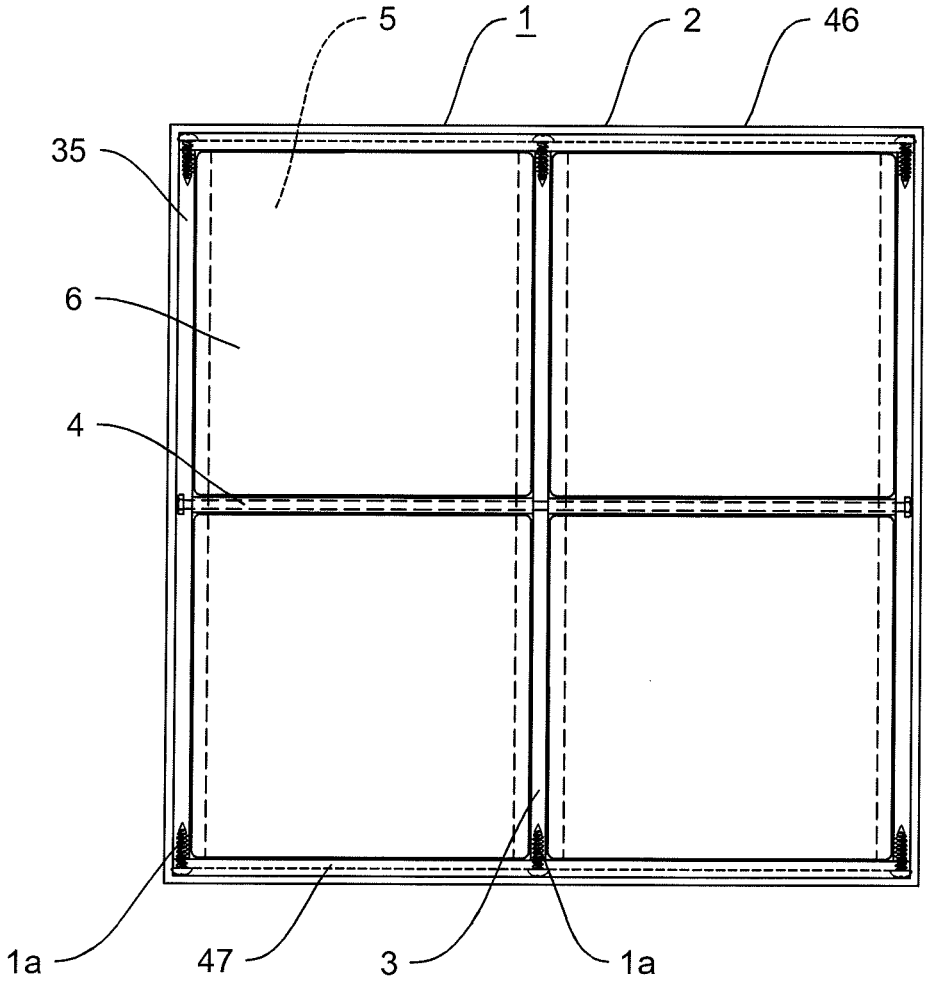
FIG. 1 shows a front elevation view of one embodiment of the framework of the instant invention.
Figure 1A:
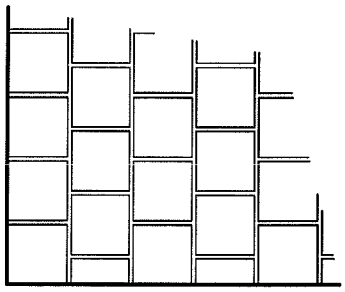
FIGS. 1A-1E show partial, front elevation views of optional framework patterns achievable by the instant invention.
Figure 1B:
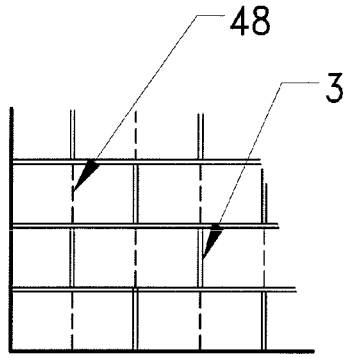
Figure 1C:
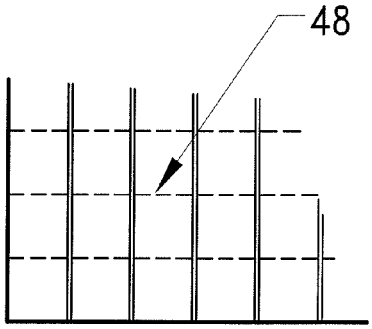
Figure 1D:
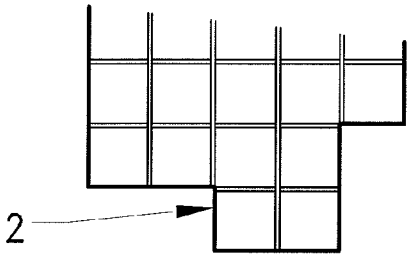
Figure 1E:
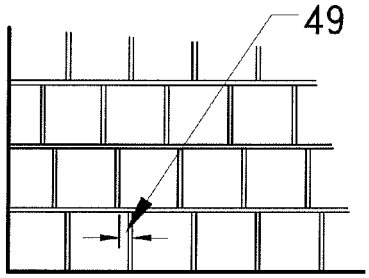

With reference then to FIGS. 1-1E, shown in an exemplary embodiment is a framework 1 including a perimeter 2, one or more outer vertical mullions 35, one or more intermediate vertical mullions 3, one or more intermediate horizontal mullions 4, one or more sill mullions 47, and one or more head mullions 46 (collectively "mullions"). Framework 1 includes the mullions such that the mullions within the perimeter 2 define one or more cavities 5 within the framework 1. The intermediate vertical mullion 3 and intermediate horizontal mullions 4 are "intermediate" in that they form the inner members of the framework 1 inside the perimeter 2. The other mullions therefore reside against the perimeter, i.e. at the head, sill, jamb or outer perimeter itself It should be understood that the terms "vertical" and "horizontal" as it relates to the mullions are used for differential purposes only meaning for instance the intermediate horizontal mullion 4 could be oriented vertically and the intermediate vertical mullion 3 could be oriented horizontally depending on the desired look or configuration of the wall system.

Perimeter 2 acts as an enclosure for the multiple mullions and allows the block system to stand-alone or be installed in a structure such as at a head, sill, or jamb or other vertical or side member of a doorway, window, or arch. The configuration of the framework 1 and perimeter 2 depends on the desired shape and look of the wall system. For instance the perimeter 2 may include a generally rectangular frame as shown by FIG. 1. However, the instant invention lends itself to optional framework 1 and perimeter 2 configurations such as, but not limited to, those shown by FIGS. 1A-1E. For example, an offset 49 can be made using staggered intermediate vertical mullions 3. The geometry of the perimeter 2 may vary. Additionally, intermittent intermediate vertical mullions 3 can be eliminated and substituted with a silicone joint 48, or the intermediate horizontal mullions 4 can be entirely substituted with a silicone joint 48. For purposes of illustration only, discussed herein is a rectangular frame with all mullions present.

Figure 2:
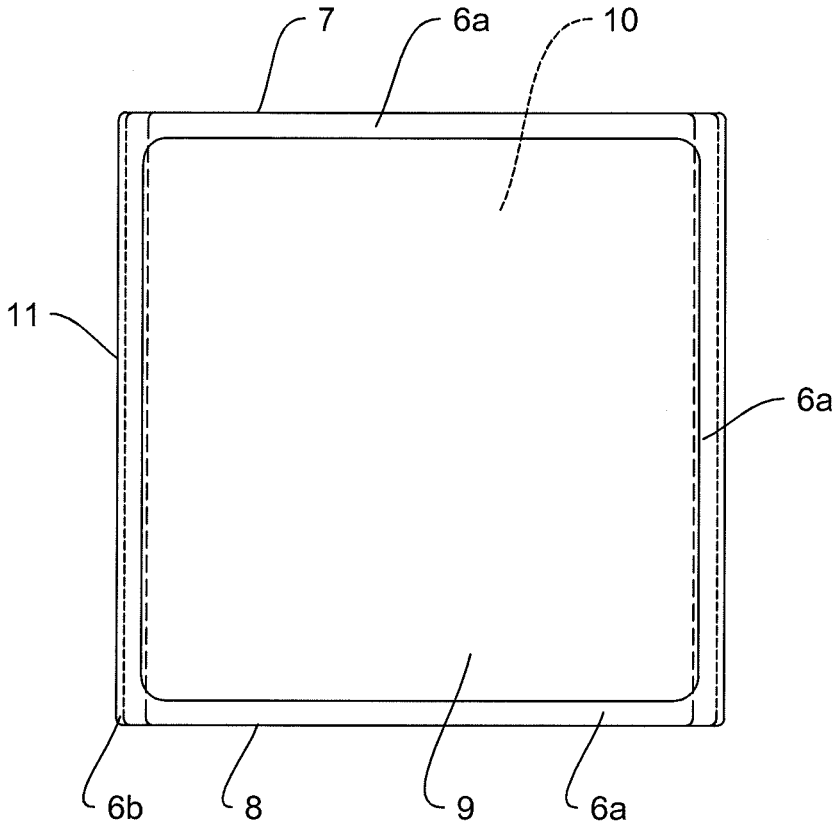
FIG. 2 shows a front elevation view of the glass block insert-able into the framework.
Figure 2A:
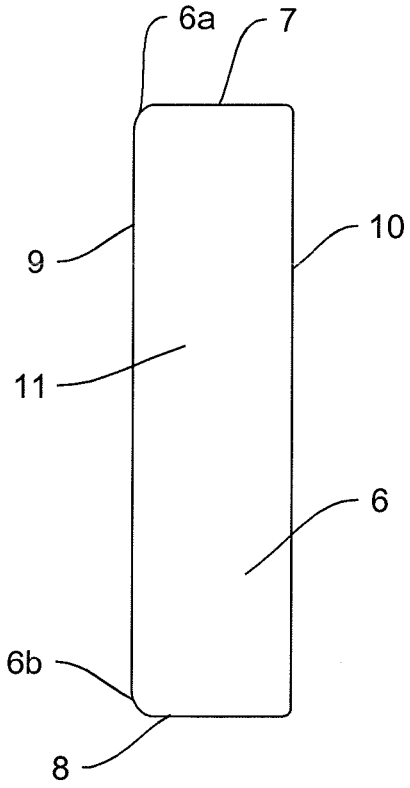
FIG. 2*a* shows a side elevation view of the glass block.
Figure 3:
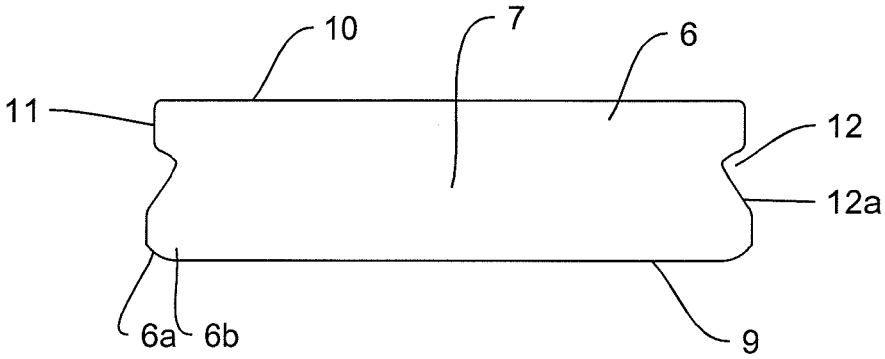
FIG. 3 shows a top plan view of a first embodiment of the glass block with side detents.

Referencing FIGS. 2-3, one or more blocks 6 have a top 7, a bottom 8, a front face 9, a back face 10, and a pair of narrow faces 11 defining the depth of the block 6. Shown herein the block 6 takes the form of an annealed, two-inch thick glass block 6 but may be any type of material as mentioned above and may take any shape as long as the narrow face 11 can accommodate the features hereof. As one example and not limited hereto, a typical glass block 6 for the instant system could have both its back face 10 and its front face 9 being flat or planar and seven inches wide and tall to be generally square when viewed frontally. Each edge of the faces terminate radially from each narrow face 11 to the front face 9 and back face 10, the radius being 5/16 inches for example, so the total width of the glass block 6 could be 7 5/8 inches with rounded block edges 6*a*. Similar rounded block edges 6*a* would be formed from the top 7 and bottom 8 to the front face 9, whereas the back face 10 would be generally more flat, excluding the rounded block edges 6*a*, at least at that substantial of a radius. A typical corner radius 6*b* along the edges of the narrow faces 11 (the narrow face 11 spanning between front face 9 and back face 10 to form its depth) could also be 3/32 inches for example.

Defined within each block 6 is one or more, preferably two, detents 12, defined within each narrow face 11. In the preferred embodiment the detent 12 is a generally triangular aperture 14 disrupting the flat narrow face 11 as shown having a slanted face 12*a* down into the narrow face 11 of the block 6.

Figure 4:
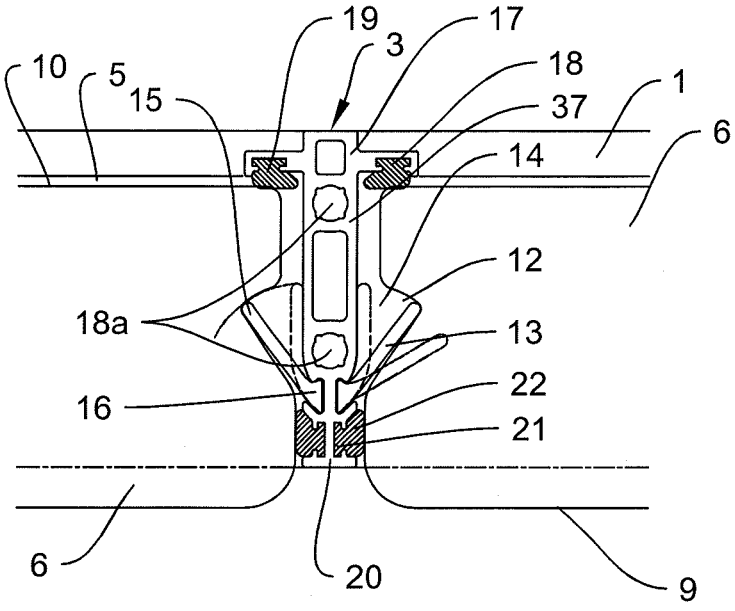
FIG. 4 shows a cross-sectional view of joined blocks through the horizontal plane including the intermediate vertical mullion with the flexible inserts disposed within the detents.

Now referencing FIG. 4, shown in vertical cross-section (through the horizontal plane) are two joined blocks 6, joined by abutting either side of an intermediate vertical mullion 3. Intermediate vertical mullion 3 therefore is an upright member of the wall system which forms at least one side of the cavity 5 and separates each block 6. Intermediate vertical mullion 3 comprises an external surface 37 and a back portion 17 disposed within the framework 1 continuous to the perimeter 2 (not shown). The back portion 17 has a pair of extending, back flanges, each having defined therein a T-slot recess 18 and a back gasket 19 contained within the T-slot recess 18 projecting outside of the framework 1 against which the back face 10 of the block 6 abuts when the glass block 6 is inserted into the cavity. The back portion 17 is shaped to prevent the blocks from being pushed too far into the framework or potentially through the framework. Back gasket 19 is preferably elastomeric and forms a seal at this rear location between the block 6 and framework 1.

A front portion 20 of intermediate vertical mullion 3 is distal to the framework 1 and would be visible, front-facing upon installation as shown. The front portion 20 has defined therein an inner slot recess 21 and an inner gasket 22 contained within the inner slot recess 21 against which the narrow face 11 of the block 6 abuts when the block 6 is inserted into the cavity 5 thereby being sealed water-tight at that location.

With continued reference to FIG. 4, in the preferred embodiment a flange 13 is anchored within the intermediate vertical mullion 3. The flange 13 is a means for retaining the block in place made of a semi-flexible but durable material such as plastic, aluminum or stainless steel. In this instance flange 13 is a strip having a free end 15 distal to the intermediate vertical mullion 3 protruding away from the external surface 37 and a fixed end 16 anchored within the intermediate vertical mullion 3. The fixed end 16 can be secured by configuring the fixed end 16 to be wider than the flange 13 itself and captured within a recess defined along the external surface 37, secured within the intermediate vertical mullion 3 by sliding the flange 13 through the recess, i.e. starting at one end of the extrusion and pulled through along its length. In this manner the flange 13 by way of its free end 15 protruding away from the recess can flex upon a compression force being applied to the free end 15 and thereafter retract into the triangular aperture 14 upon relaxation. In other words, the flange 13 flexes by the force of a forwardly-pushed block 6 and thereafter retracts to embed itself into the detent 12 when the block 6 or glass block 6 is inserted into the cavity 5 such that the glass block 6 is "snapped" into and retained within the framework 1. Each intermediate vertical mullion 3 (and intermediate horizontal mullion 4) can be fastened to the framework 1 and stiffened using any type of fastening means such as a rivet or screw or similar, termed herein frame screw 1*a* (FIG. 1, FIG. 7), driven into track 18*a*. It should be understood that the track 18*a* is an internal void having a totally enclosed volume which is sized to accept threaded rods, as further described.

Figure 5:
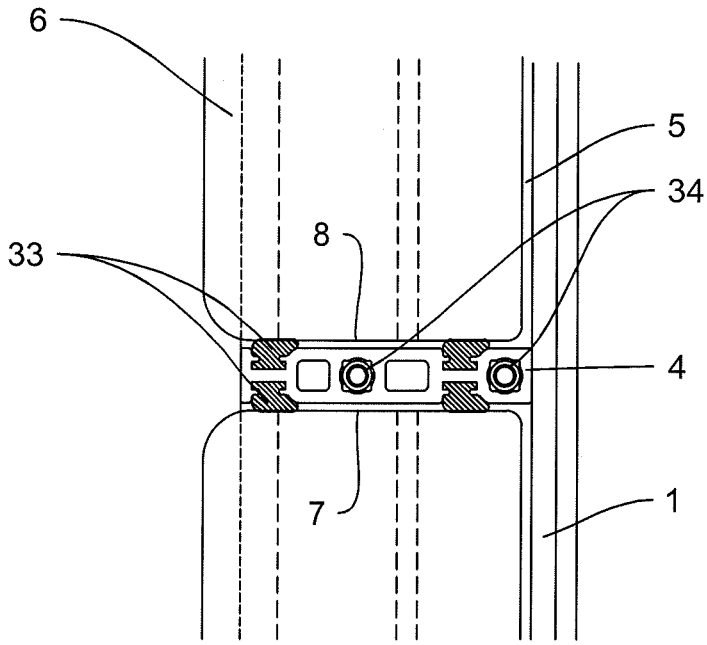
FIG. 5 shows a cross-sectional view of joined blocks through the vertical plane including the intermediate horizontal mullion.

With reference to FIG. 5, shown is a horizontal cross-sectional view of joined blocks 6 (through the vertical plane) revealing the intermediate horizontal mullion 4. The intermediate horizontal mullion 4 does not have to include any flanges 13 (FIG. 4) as shown but can also be configured to include a similar flanges as the intermediate vertical mullion 3, for instance if the intermediate vertical mullions 3 were not present by design choice. Preferably, each intermediate horizontal mullion 4 spans between each intermediate vertical mullion 3 (FIG. 1) preferably perpendicularly (depending on the shape of the block) to form at least one other side of each cavity 5. One or more horizontal gaskets 33 acting as a seal are disposed within the intermediate horizontal mullion 4 to abut the bottom 8 or the top 7 of each block 6 when the block 6 is inserted into the cavity 5. Each intermediate horizontal mullion 4 may be stiffened by providing one or more through-rods 34 contained within hollows of the intermediate horizontal mullion 4, for instance one steel rod disposed medially within the intermediate horizontal mullion 4 and one steel rod situated proximate to the framework 1. Of note is that these hollows are identical to the tracks 18*a* of the intermediate vertical mullions 3 and are labeled accordingly as tracks 18*a* because both the intermediate horizontal mullions 4 and intermediate vertical mullions 3 can accept either the through-rods 34 or frame screw 1*a*. This lends itself to the ability to strengthen the variable configurations discussed above.

Figure 6:
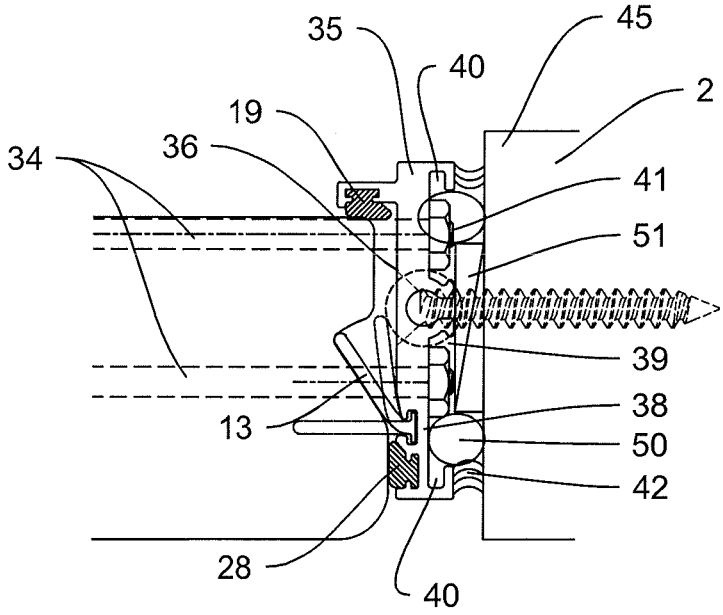
FIG. 6 shows a cross-sectional view of a block through the horizontal plane and as disposed against a jamb.
Figure 7:
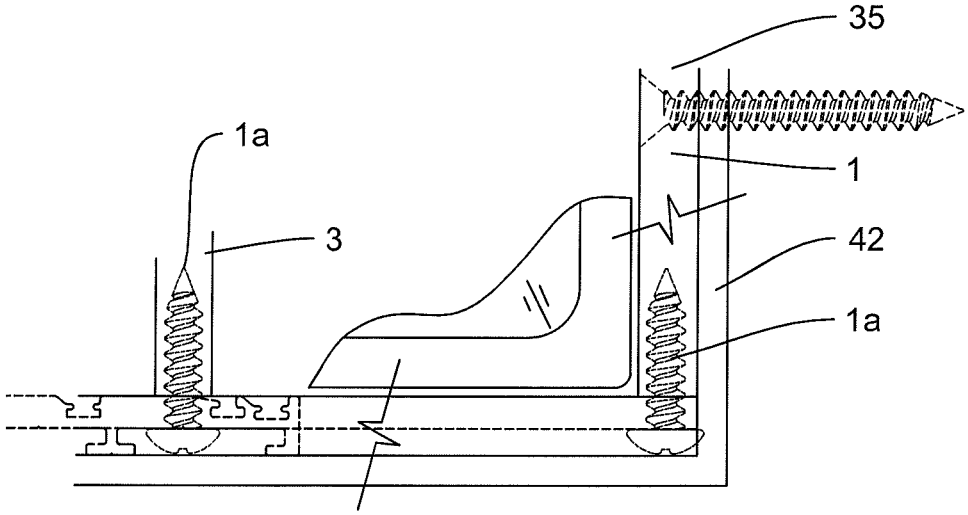
FIG. 7 shows a partial elevation view of the block installed along the outer perimeter of the framework.

FIGS. 6 and 7, show, respectively, a cross-sectional view of a block 6 through the horizontal plane and as disposed against a jamb 45 (as the perimeter 2) and a partial elevation view of the block 6 installed along the outer perimeter 2. An outer vertical mullion 35 therefore is parallel to each the intermediate vertical mullion 3 and fastened to the perimeter 2 to form an outer boundary of framework 1. The outer vertical mullion 35 has an inner surface 36 as shown which is identical to the external surface 37 (FIG. 4) of the intermediate vertical mullion 3 and thus includes the back gasket 19, vertical gasket 28, and flange 13. The outer surface 38 opposing the inner surface 36 and facing the perimeter 2 however is spaced from the perimeter 2 to define a space 39 and a pair of pockets 40. Each pocket contains a rod end 41 of each steel rod 34 away from the perimeter 2 (the steel rods 34 through the intermediate horizontal mullions 4 having terminated). A sealant 42 such as silicone, latex or polyurethane then is used to seal the space 39. The resulting space 39 also can accommodate a shim 51 and caulk backer rod 50 (see also FIG. 8) as needed. A fastener such as a countersunk screw secures the outer vertical mullion 35 to the jamb 45. Shown in elevation (FIG. 7), any type of additional fasteners, termed herein frame screw 1*a*, can be used along the perimeter 2 to secure all intermediate vertical mullions 3 and outer vertical mullions 35 to the perimeter 2 as they penetrate screw bosses defined at the ends of the mullions (see also FIG. 4).

Figure 8:
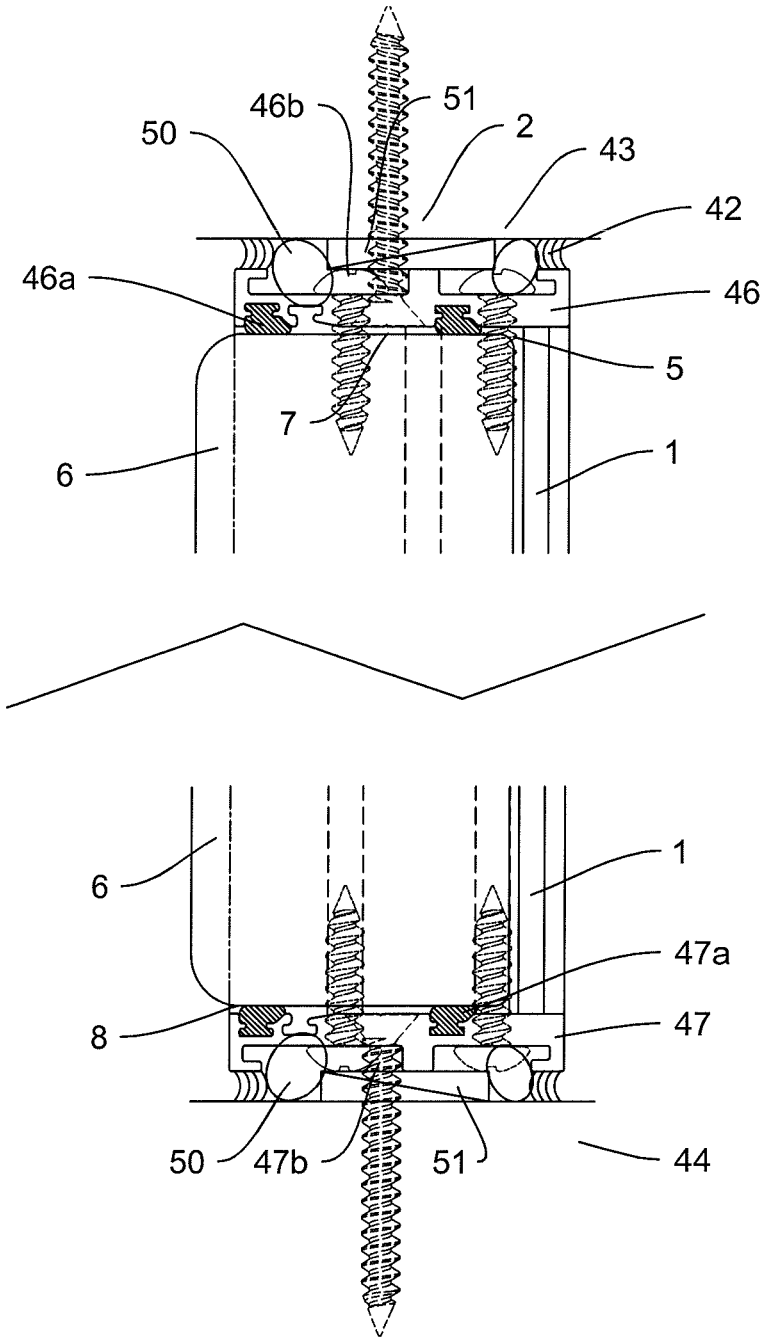
FIG. 8 shows partial elevation views of the block as installed along head and sill members.

Referencing FIG. 8, shown are exemplary embodiments of a head mullion 46 and a sill mullion 47 which act as outermost horizontal mullions disposed against the perimeter 2 at a top and bottom, respectively, when the perimeter 2 takes the form of a head 43 or sill 44. In this instance, again, no flanges 13 (FIG. 4) would be used, rather the blocks 6 disposed against the head mullion 46 would already have been secured within cavity 5 using the flanges 13 on the outer vertical mullion 35 (FIG. 7) and intermediate vertical mullions 3 (FIG. 4). Therefore the top 7 of the topmost block 6 within the framework 1 abuts one or more head gaskets 46*a* secured within the head mullion 46, and the bottom 8 of the bottommost block 6 within the framework 1 abuts one or more sill gaskets 47*a*. As shown the head mullion 46 is an extrusion which include the gaskets on one side and a defined head mullion pocket 46*b* on an opposing side which can be filled with a sealant 42 and further contain the head 43 of a fastener, spacer, and/or additional spacing or stiffening members such as rod stock. Similarly, the sill mullion 47 is an extrusion which includes the gaskets on one side and one or more sill mullion pockets 47*b* which can contain additional fastener heads, sealants, spacers, and/or additional stiffening members.

Figure 9:
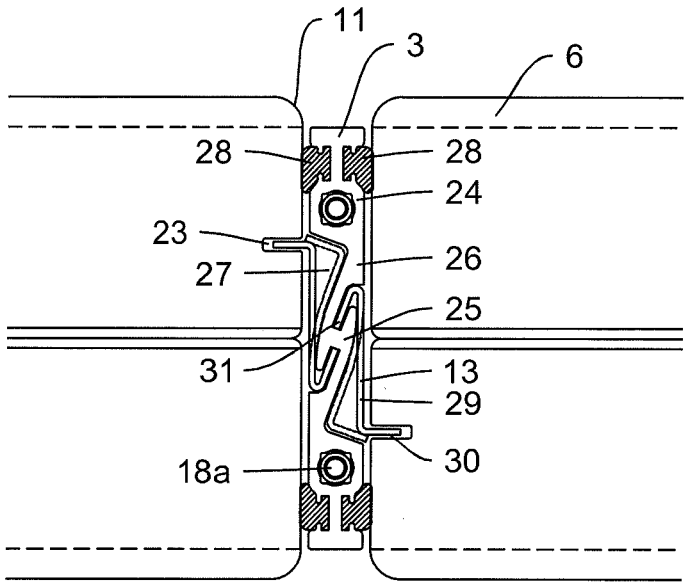
FIG. 9 shows a cross-sectional view of an alternative embodiment of the intermediate vertical mullion through the horizontal plane including an S-shaped flange.

FIG. 9 shows an alternative embodiment of the intermediate vertical mullion 3. Here, the block's detent along the narrow face 11 is a rectangular slot 23. The intermediate vertical mullion 3 here has two end portions 24 and includes a medial portion 25 and a pair of narrow portions 26 on opposing sides of the medial portion 25 terminating at the end portions 24, each narrow portion 26 defined by a cut-out 27 down into the medial portion 25 angling towards the end portions 24 as shown to define the narrow portions 26. A pair of vertical gaskets 28 acting as a seal are disposed at each end portion 24 situated to abut each narrow face 11. In this embodiment the flange 13 or block retention means is an S-shaped clip 29 having a perpendicular end 30 adapted to flex down into the cut-out 27 and for engaging the rectangular slot 23 upon retraction, and a bent end 31 anchored within an intermediate slot defined within the medial portion 25 which acts as a fulcrum for the perpendicular end 30. In a similar manner therefore, the perpendicular end 30 of S-shaped clip 29 flexes by the force of a pushed block 6 and thereafter retracts to embed itself into the rectangular slot 23 when the block 6 is inserted into the cavity 5 such that the block 6 is "snapped" into and retained within the framework 1. It should be noted that any outer vertical mullion containing the S-shaped clip 29 embodiment as the block retention insert would contain similar features of the mullion embodiment described herein on at least one external surface, similar to the mirrored surfaces described above (FIG. 6) for the first embodiment and would also contain identical screw tracks 18*a* and framework fastening means, also described above.

I claim:

1. A block system, comprising:

a framework including one or more mullions, said mullions defining one or more cavities, wherein at least one of said mullions has a recess defined along an external surface;

a block having a top, a bottom, a front face, a back face, and a pair of narrow faces;

one or more detents defined within each said narrow face; and, a flange anchored within said mullion, said flange defined as a strip having a free end and a fixed end, said fixed end wider than said free end, said fixed end adapted to be pulled through said recess of said mullion to be captured thereon, wherein said flange flexes and thereafter retracts to embed itself into said detent when said block is inserted into said cavity such that said block is retained within said framework.

2. The block system of claim 1, wherein said framework has a perimeter and said one or more mullions include an intermediate vertical mullion and an intermediate horizontal mullion.

3. The block system of claim 2, wherein said intermediate vertical mullion further comprises a back portion disposed within said framework continuous to said perimeter, said back portion having defined therein a T-slot recess and a back gasket contained within said T-slot recess projecting outside of said framework against which said back face of said block abuts when said block is inserted into said cavity.

4. The block system of claim 2, wherein said intermediate vertical mullion further comprises a front portion distal to said framework, said front portion having defined therein an inner slot recess and an inner gasket contained within said inner slot recess against which said narrow portion abuts when said block is inserted into said cavity.

5. The block system of claim 2, wherein said intermediate horizontal mullion spans between said intermediate vertical mullion and further includes one or more horizontal gaskets disposed to abut said bottom or said top of said block.

6. The block system of claim 5, further comprising one or more steel rods contained within said intermediate horizontal mullion.

7. The block system of claim 2, further comprising an outer vertical mullion fastened to said perimeter parallel to said intermediate vertical mullion, said outer vertical mullion having an inner surface identical to an external surface of said intermediate vertical mullion, said outer vertical mullion having an opposing outer surface, said outer surface spaced from said perimeter to define a space and a pair of pockets, said pockets containing a rod end of said steel rod away from said perimeter.

8. The block system of claim 7, further comprising a sealant filling said space.

9. The block system of claim 1, wherein said block is a glass block.

10. The block system of claim 1, wherein said detent is a triangular aperture.

11. The block system of claim 1, wherein said detent is a rectangular slot.

12. The block system of claim 11, wherein said intermediate vertical mullion has two end portions and includes a medial portion and a pair of narrow portions on opposing sides of said medial portion terminating at said end portions, each said narrow portion defined by a cut-out angling towards said end portions down into said medial portion.

13. The block system of claim 12, wherein said intermediate vertical mullion includes a pair of vertical gaskets disposed at each said end portion situated to abut each said narrow face.

14. The block system of claim 12, wherein said flange is an S-shaped clip having a perpendicular end adapted to flex down into said cut-out and for engaging said rectangular slot upon retraction, and a bent end anchored within an intermediate slot defined within said medial portion acting as a fulcrum for said perpendicular end.

15. The block system of claim 1, further comprising a means for fastening said framework to a head or sill.

16. A block system, comprising:

a framework having a perimeter, an intermediate vertical mullion, and an intermediate horizontal mullion, wherein said perimeter, said intermediate vertical mullion and said intermediate horizontal mullion define one or more cavities within said framework;

a block having a top, a bottom, a front face, and a back face;

said intermediate vertical mullion further comprising a back portion disposed within said framework continuous to said perimeter, said back portion having defined therein a T-slot recess and a back gasket contained within said T-slot recess projecting outside of said framework against which said back face of said block abuts when said block is inserted into said cavity;

wherein said intermediate vertical mullion further comprises a front portion distal to said framework, said front portion having defined therein an inner slot recess and an inner gasket contained within said inner slot recess;

said intermediate vertical mullion having defined therein a hollow screw track, said screw track defining an internal void having a totally enclosed volume for containing a steel rod within said intermediate vertical mullion; and, a means for retaining said block within said framework when said block is pushed forward into said cavity.

17. The block system of claim 16, wherein said intermediate horizontal mullion spans between said intermediate vertical mullion and further includes one or more horizontal gaskets disposed to abut said bottom or said top of said block.

* * * * *